US010227550B2

(12) United States Patent
Mena-Brito

(10) Patent No.: US 10,227,550 B2
(45) Date of Patent: Mar. 12, 2019

(54) CLEANING COMPOSITION

(71) Applicant: Colgate-Palmolive Company, New York, NY (US)

(72) Inventor: Rodrigo Mena-Brito, Charlotte, NC (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/649,852

(22) PCT Filed: Dec. 7, 2012

(86) PCT No.: PCT/US2012/068421
§ 371 (c)(1),
(2) Date: Jun. 4, 2015

(87) PCT Pub. No.: WO2014/088589
PCT Pub. Date: Jun. 12, 2014

(65) Prior Publication Data

US 2015/0315519 A1 Nov. 5, 2015

(51) Int. Cl.

| | |
|---|---|
| ***C11D 1/06*** | (2006.01) |
| ***C11D 1/29*** | (2006.01) |
| ***C11D 1/37*** | (2006.01) |
| ***C11D 1/75*** | (2006.01) |
| ***C11D 3/30*** | (2006.01) |
| ***C11D 1/94*** | (2006.01) |
| ***C11D 1/88*** | (2006.01) |
| ***C11D 1/83*** | (2006.01) |

(52) U.S. Cl.
CPC ..... *C11D 1/94* (2013.01); *C11D 1/06* (2013.01); *C11D 1/29* (2013.01); *C11D 1/75* (2013.01); *C11D 1/83* (2013.01); *C11D 1/88* (2013.01); *C11D 3/30* (2013.01)

(58) Field of Classification Search
CPC .... C11D 1/29; C11D 1/75; C11D 1/83; C11D 1/88; C11D 1/94; C11D 3/30
USPC ..... 510/237, 238, 427, 503, 505, 506
See application file for complete search history.

(56) References Cited

U.S. PATENT DOCUMENTS

| | | | |
|---|---|---|---|
| 4,092,272 | A | 5/1978 | Nishimura et al. |
| 4,316,824 | A | 2/1982 | Pancheri |
| 4,877,546 | A | 10/1989 | Lai |
| 5,378,409 | A | 1/1995 | Ofosu-Asante |
| 5,494,612 | A | 2/1996 | Finucane |
| 5,783,554 | A | 7/1998 | Li et al. |
| 2012/0231989 | A1 | 9/2012 | Murphy et al. |

FOREIGN PATENT DOCUMENTS

| | | |
|---|---|---|
| GB | 2219594 | * 12/1989 |
| GB | 2292562 | * 2/1996 |
| WO | WO 92/008777 | 5/1992 |
| WO | WO 94/005755 | 3/1994 |
| WO | WO 94/005769 | 3/1994 |
| WO | WO 94/012608 | 6/1994 |
| WO | WO 95/006108 | 3/1995 |
| WO | WO 07/141067 | 12/2007 |

OTHER PUBLICATIONS

International Search Report and Written Opinion in International Application No. PCT/US2012/068421, dated Aug. 8, 2013.
Kao Chemicals GmbH, 2012, "AKYPO® LM-40 Technical Data Sheet Preliminary Version," www.kaochemicals-eu.com.
Kume et al., 2008, "Review on Anionic/Cationic Surfactant Mixtures," J. Surfact Deterg 11:1-11.
Muherei et al, 2009, "Investigating Synergism in Critical Micelle Concentration of Anionic-Nonionic Surfactant Mixtures: Surface Versus Interfacial Tension Techniques," Asian Journal of Applied Sciences 2(2):115-127.
O'Lenick, Editor, 2009, "Surfactant Spectator," vol. 1, No. 3 www.surfactantspectator.com.
Salager, 2002, "FIRP Booklet #E300—A Surfactants Types and Uses," Laboratory of Formulation, Interfaces, Rheology and Processes, Universidad De Los Andes, Version #2.
Wang et al., 2005, "Molecular interaction in binary surfactant mixtures containing alkyl polyglycoside," Journal of Colloid and Interface Science 290:598-602.
Written Opinion in International Application No. PCT/US2012/068421, dated Nov. 28, 2014.

* cited by examiner

*Primary Examiner* — Gregory R Delcotto

(57) ABSTRACT

A cleaning composition comprising a surfactant combination which comprises an amine oxide amphoteric surfactant; a first anionic surfactant comprising a poly(oxyalkylene) alkyl ether sulfate: and a second anionic surfactant comprising an alkyl ethoxy carboxylate. The combination provides increased foaming.

11 Claims, No Drawings

CLEANING COMPOSITION

BACKGROUND OF THE INVENTION

Cleaning compositions such as light duty cleaning compositions may be used for cleaning a variety of surfaces including animate and inanimate surfaces. Inanimate surfaces include hard surfaces of the sort found in kitchens and bathrooms from sinks and work surfaces to pans and dishes. Such cleaning compositions may be formulated in solid, liquid or gel form and are typically used in liquid form, for example as an aqueous liquid. The compositions generally contain one or more surfactants. Such surfactants may be non-ionic surfactants, anionic surfactants, cationic surfactants or amphoteric surfactants. Surfactants are surface active agents which tend to be amphiphilic molecules capable of interacting with soil to be cleaned from a surface to enable the surface to be cleaned. A wide variety of chemically different surfactants are known for such purposes.

It is known to provide compositions which are mixtures of different surfactants. However, it is difficult to predict what effect mixing surfactants may have because of a wide variation in the chemical structure of individual surfactants. Complexes between chemically different surfactants can give rise to compositions which are unstable and which may form precipitates, thereby rendering them useless for cleaning purposes.

The effectiveness of surfactant compositions in cleaning may be assessed by the effect of the surfactant on surface tension and by the ability of the surfactant to generate foam. Cleaning compositions which produce foam tend to be more effective than those which do not. It has been found that high surfactant concentrations in cleaning compositions result in effective cleaning and high foam. However, such compositions may have high production costs in view of the costs of the surfactants. In addition, rinsing of cleaned surfaces results in high concentrations of surfactant being disposed into drainage, which is undesirable in view of the potentially damaging effect on the environment.

There is therefore a need to provide cleaning compositions which are effective in cleaning, which produce good foam and which do so using lower total amounts of surfactant.

BRIEF SUMMARY OF THE INVENTION

In a first aspect, the invention provides a cleaning composition comprising a surfactant combination which comprises an amine oxide amphoteric surfactant; a first anionic surfactant comprising a poly(oxyalkylene) alkyl ether sulfate: and a second anionic surfactant comprising an alkyl ethoxy carboxylate.

It has been found that by using this surfactant combination, a cleaning composition may be produced which is effective in cleaning and has the ability to generate foam using lower amounts of total surfactant than previously used. Because lower total surfactant amounts provide the same cleaning performance this allows the development of cleaning compositions at lower cost. This also means that lower quantities of surfactants are disposed to drainage thereby reducing impact on the environment.

The amine oxide amphoteric surfactant may comprise an alkyl dimethyl amine oxide surfactant in which the alkyl group typically has from 8 to 18 carbon atoms. Optionally, the alkyl dimethyl amine oxide is lauryl dimethyl amine oxide, myristyl dimethyl amine oxide or a mixture thereof.

In certain embodiments, the amine oxide amphoteric surfactant is present in an amount of 2 to 20% by weight of the composition. In other embodiments, the amount is at least 2 up to 19, 18, 17, 16, 15, 14, 13, 12, 11, or 10 wt. %. In other embodiments, the amount is at least 3, at least 4, at least 5, at least 6, at least 7, at least 8, at least 9, or at least 10 up to 20 wt. %. In one embodiment, the amount is 5 to 15 wt. %.

The poly(oxyalkylene) alkyl ether sulfate may be a poly (oxyethylene) alkyl ether sulfate. The poly(oxyethylene) alkyl ether sulfate may have the following general formula: $RO—(CH_2—CH_2—O)_n—SO_3—X^+$ in which $X^+$ is a counterion such as ammonium and n is zero or an integer. The poly(oxyethylene) alkyl ether sulfate may be present as a mixture of poly(oxyethylene) alkyl ether sulfates with different values for n.

Optionally, the poly(oxyethylene) alkyl ether sulfate is ammonium poly(oxyethylene) lauryl ether sulfate. Optionally, the average ethoxy content of the poly(oxyethylene) alkyl ether sulfate is about 0.6/mole.

In certain embodiments, the poly(oxyalkylene) alkyl ether sulfate is present in an amount of 2 to 20% by weight of the composition. In other embodiments, the amount is at least 2 up to 19, 18, 17, 16, 15, 14, 13, 12, 11, or 10 wt. %. In other embodiments, the amount is at least 3, at least 4, at least 5, at least 6, at least 7, at least 8, at least 9, or at least 10 up to 20 wt. %. In one embodiment, the amount is 5 to 15 wt. %.

The alkyl ethoxycarboxylate may include an alkyl group having from 8 to 18 carbon atoms. The alkyl ethoxycarboxylate may be represented by the following general formula: $RO—(CH_2—CH_2—O)_mCH_2CO_2H$ in which m is zero or an integer. The alkyl ethoxycarboxylate may be present as a mixture of alkyl ethoxycarboxylates with different values for m and different R groups.

Optionally, the alkyl ethoxycarboxylate is lauryl ether carboxylic acid, myristyl ether carboxylic acid or a mixture thereof. Optionally, the average ethoxy content of the alkyl ethoxycarboxylate is more than 3/mole.

In certain embodiments, the alkyl ethoxycarboxylate is present in an amount of 1 to 15% by weight of the composition. In other embodiments, the amount is at least 1 up to 14, 13, 12, 11, 10, 9, 8, 7, or 6 wt. %. In other embodiment, the amount is at least 1, at least 2, at least 3, at least 4, or at least 5 up to 15 wt. %. In one embodiment, the amount is 1 to 5 wt. %. In one embodiment, the amount is 1 to 2 wt. %.

In one arrangement, the cleaning composition comprises a surfactant combination comprising an amine oxide amphoteric surfactant which is a mixture of lauryl dimethyl amine oxide and myristyl dimethyl amine oxide and which includes at least two anionic surfactants which are (a) ammonium poly(oxyethylene) lauryl ether sulfate having an average ethoxy content of around 0.6/mole and (b) a mixture of lauryl ether carboxylic acid and myristyl ether carboxylic acid having an average ethoxy content of more than 3/mole.

In one arrangement the amine oxide amphoteric surfactant comprises a mixture of lauryl dimethyl amine oxide and myristyl dimethyl amine oxide and the at least two anionic surfactants are (a) ammonium poly(oxyethylene) lauryl ether sulphate having an average ethoxy content of about 0.6/mole and (b) an alkyl ethoxy carboxylate.

In one arrangement, the amine oxide amphoteric surfactant comprises a mixture of lauryl dimethyl amine oxide and myristyl dimethyl amine oxide and the at least two anionic surfactants are (a) ammonium poly(oxyethylene) lauryl ether sulphate having an average ethoxy content of about 3/mole and (b) an alkyl ethoxy carboxylate.

Optionally, the weight ratios of anionic surfactant (a) to the amphoteric surfactant is from 1:3 to 3:1, optionally, from 1:2 to 2:1, optionally 1:1.

Optionally, the amount of anionic surfactant (b) by weight in the surfactant combination is no more than 15%, optionally no more than 12.5%, optionally no more than 10%.

Optionally, the cleaning composition according to the invention further comprises a hydrotope .

Optionally, the cleaning composition according to the invention further comprises water. In this way a liquid composition may be formed. Alternatively, a gel composition may be formed.

The surfactant combination is typically present in an amount of 5 to 30% by weight of the composition. In other embodiments, the amount is 10 to 30%, 10 to 20%, 10 to 17%, 10 to 15%, 15 to 20%, or 15% to 25% by weight.

In a second aspect, the present invention provides a method of cleaning a surface, which comprises contacting the surface with a composition as described herein.

In a third aspect, the present invention provides a process for the production of a cleaning composition which comprises combining an amine oxide amphoteric surfactant with at least two anionic surfactants comprising a poly(oxyalkylene) alkyl ether sulfate and an alkyl ethoxy carboxylate so as to form a surfactant combination which comprises the cleaning composition or which is incorporated into the cleaning composition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

The compositions described herein have utility in a broad range of applications including, for example, in consumer product fluids such as dish cleaners, surface cleaners, cleansers and the like. The compositions are highly suitable for cleaning surfaces that are designed for food-contact uses, such as dishes, silverware, glasses and cups. The cleaning compositions of the invention are useful as ultra and regular density dish liquid formulas The invention also encompasses methods of cleaning a surface including contacting the surface with a composition of the invention, diluted or undiluted.

Solvents

The invention in certain embodiments can also include one or more solvents. Typical solvents used in the composition are aqueous soluble, miscible or immiscible. Solvents can include aliphatic and aromatic hydrocarbons, chlorinated hydrocarbons, alcohols, ether compounds, fluorocarbon compounds, and other similar low molecular weight generally volatile liquid materials. Of these, preferred are alkanols; more preferred are ethanol, isopropanol, and propanol; and most preferred is ethanol. In a particularly desirable embodiment, the solvents of the cleaning composition are of alkanols, and more preferably the solvent is ethanol. In various embodiments, the compositions may include solvents in amounts of up to about 6 wt. %, preferably at least about wt. 0.1% by weight of the total composition.

In certain embodiments, water is not a solvent but when used acts as a diluent or as a dispersing medium for the active materials. In other embodiments, water is a solvent.

These materials can be used in solution or as a miscible mixture or as a dispersion of the solvent in the aqueous liquid. A solvent or cosolvent can be used to enhance certain soil removal properties of this invention. Cosolvents include alcohols and the mono and di-alkyl ethers of alkylene glycols, dialkylene glycols, trialkylene glycols, etc. Alcohols which are useful as cosolvents in this invention include methanol, ethanol, propanol and isopropanol. Other suitable solvents include the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme. Nonaqueous liquid solvents can be used for varying compositions of the present invention. These include the higher glycols, polyglycols, polyoxides and glycol ethers.

Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), propylene glycol n-butyl ether, dipropylene glycol monobutyl ether, ethylene glycol n-butyl ether and ethylene glycol n-propyl ether, and combinations thereof. In certain embodiments, the glycol solvent is propylene glycol n-butyl ether. In certain embodiments, the glycol solvent is dipropylene glycol monobutyl ether.

Other useful solvents are ethylene oxide/propylene oxide, liquid random copolymer such as Synalox solvent series from Dow Chemical (e.g., Synalox 50-50B). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the trade name Dowanol). Also tripropylene glycol mono methyl ether "Dowanol TPM" from Dow Chemical is suitable.

The final ingredient in the inventive cleaning compositions is water. The proportion of water in the compositions generally is in the range of about 35% to about 90% or about 50% to 85% by weight of the cleaning composition.

Additional Optional Ingredients

Examples of additional optional components that can be included in the claning composition include, but are not limited to, hydrotropes, sequestering agents, antibacterial agents, fluorescent whitening agents, photobleaches, fiber lubricants, reducing agents, enzymes, enzyme stabilizing agents, powder finishing agents, builders, bleaches, bleach catalysts, soil release agents, dye transfer inhibitors, buffers, colorants, fragrances, pro-fragrances, rheology modifiers, anti-ashing polymers, soil repellents, water-resistance agents, suspending agents, aesthetic agents, structuring agents, sanitizers, solvents, fabric finishing agents, dye fixatives, fabric conditioning agents, and deodorizers. The proportion of such additional materials, in total will normally not exceed 15% by weight of the detergent composition, and the percentages of illustrative examples of such individual components will be about 5% by weight.

Process of Manufacture

The compositions are readily made by simple mixing methods from readily available components.

Methods of Use

The invention encompasses cleaning compositions useful for cleaning a surface.

By surfaces, it is meant herein any kind of surfaces typically found in houses like kitchens, bathrooms, or the exterior surfaces of a vehicle, for example, floors, walls, tiles, windows, sinks, showers, shower plastified curtains, wash basins, WCs, dishes and other food contact surfaces, fixtures and fittings and the like made of different materials like ceramic, vinyl, no-wax vinyl, linoleum, melamine, glass, any plastics, plastified wood, metal, especially steel and chrome metal or any painted or varnished or sealed surface and the like. Surfaces also include household appliances including, but not limited to, refrigerators, garbage cans, freezers, washing machines, automatic dryers, ovens, microwave ovens, dishwashers and so on. The present composition is especially efficacious in the cleaning of ceramic, steel, plastic, glass and the exterior painted or otherwise finished surface of a vehicle, for example, a car. The cleaning compositions are also safe on the skin.

The cleaning composition is applied to the surface, undiluted or diluted, optionally after a pre-rinse step. The cleaning composition can be diluted with water, preferably up to a dilution ratio of 1:20, without significantly affecting its cleaning and antimicrobial efficacies. The composition can be applied using a cloth or sponge onto which the composition has been applied or by pouring the composition over the surface. Alternatively the composition may be applied by spraying the composition onto the surface using a spraying device as described above. The cleaning compositions of the invention can be left to sit on a surface or be wiped or scrubbed on or from the surface.

Once the composition has been applied to the surface, the surface can then be optionally rinsed, usually with water, and left to dry naturally. Optionally the user can wait in between application of the composition and rinsing in order to allow the composition maximum working time. A particular benefit of the composition is that the surface can be cleaned as described above with minimal rinsing and the surface left to dry naturally without accumulating physiologically harmful deposits, and/or with reduced or no corrosion.

The following examples illustrate compositions of the invention. Unless otherwise specified, all percentages are by weight. The exemplified compositions are illustrative only and do not limit the scope of the invention. Unless otherwise specified, the proportions in the examples and elsewhere in the specification are by active weight. The active weight of a material is the weight of the material itself excluding water or other materials that may be present in the supplied form of the material.

EXAMPLE

The following abbreviations are used in the Example:

Ammonium lauryl ether sulfate (ALES)

Lauryl/myristyl ether carboxylic acid (ECA)

Lauryl/myristyl dimethyl amine oxide (LMDO)

EO refers to degree of ethoxylation

The table below compares the foam forming capabilities of compositions according to the invention compared to a commercial formula. Formulations 1 to 4 each contain ALES 0.6, LMDO and ECA. All of these have an active surfactant amount of 16.9%. The commercial product at 100% has an active surfactant amount of 22.6%, and at 76% concentration, it has a comparable 16.9% active surfactant amount.

| Material | 1 | 2 | 3 | 4 | Comparative ECA only | Commercial | Commercial at 76% |
|---|---|---|---|---|---|---|---|
| ECA | 11.3 | 2.95 | 5.7 | 2.95 | 16.9 | 0 | 0 |
| ALES 0.6 | 2.8 | 11.15 | 5.6 | 2.8 | 0 | 17.3 | 13.2 |
| LMDO | 2.8 | 2.8 | 5.6 | 11.15 | 0 | 4.8 | 3.7 |
| Water and minors | Q.S. | Q.S. | Q.S. | Q.S. | Q.S. | Q.S | Q.S. |

| Sample | Foam Height without milk (mm) | Foam Height with Milk (mm) |
|---|---|---|
| 1 | 515 | 250 |
| 2 | 510 | 240 |
| 3 | 490 | 250 |
| 4 | 485 | 260 |
| Comparative - ECA only | 490 | 250 |
| Commercial at 76% | 460 | 240 |
| Commercial at 100% | 470 | 260 |

From the table above, it can be seen that the inventive combination of surfactants produces more foam (in the absence of milk) at the same surfactant level as the comparative and even when the comparative is at a higher surfactant level. The inventive combinations have the about the same or better performance compared to ECA alone, but the formula with ECA alone is much more expensive than the inventive combination. The inventive combination can provide the level of foaming at a much reduced cost. When milk is present, the compositions are comparable for foam. The testing with milk is indicative of the cleaning performance of the composition. The inclusion of ECA results in the same or slightly better cleaning indication compared to the commercial at the same active ingredient level.

Shake-Foam Test 100 ml of a diluted (0.033%) test solution in 150 ppm hardness water at room temperature (23° C.) is filled into a 500 ml graduated cylinder with a stopper. The stoppered cylinder is placed on an agitating machine, which rotates the cylinder for 40 cycles at 30 rpm. The height of the foam in the cylinder is observed. A milk soil is then introduced (about 175 μL) into the cylinder. The cylinder is then inverted 40 times more, and the height after soil addition is recorded as ml of foam.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A cleaning composition comprising a surfactant combination, the surfactant combination comprising:

(i) an alkyl dimethyl amine oxide amphoteric surfactant, wherein the alkyl dimethyl amine oxide is lauryl dimethyl amine oxide, myristyl dimethyl amine oxide or a mixture thereof;

(ii) a first anionic surfactant comprising a poly(oxyethylene) alkyl ether sulfate, wherein the poly(oxyethylene) alkyl ether sulfate is ammonium poly(oxyethylene) lauryl ether sulfate; and (iii) a second anionic surfactant comprising an alkyl ethoxy carboxylate, wherein the alkyl ethoxy carboxylate is lauryl ether carboxylic acid, myristyl ether carboxylic acid or a mixture thereof, wherein the amount of the second anionic surfactant is 2.95 to 11.3% by weight of the composition, and wherein the alkyl dimethyl amine oxide amphoteric surfactant and the first anionic surfactant are present in an amount of 5.6 to 13.95% by weight of the composition.

2. The cleaning composition according to claim 1, wherein the alkyl dimethyl amine oxide amphoteric surfactant is present in an amount of 2.8 to 11.15% by weight of the composition.

3. The cleaning composition according to claim 1, wherein the average ethoxy content of the poly(oxyethylene) alkyl ether sulfate is from 0.3 to 4/mole.

4. The cleaning composition according to claim 1, wherein the average ethoxy content of the alkyl ethoxy carboxylate is more than 3/mole.

5. The cleaning composition according to claim 1, wherein a weight ratio of anionic surfactants to the amphoteric surfactant is from 1:3 to 3:1.

6. The cleaning composition according to claim 1, wherein the alkyl dimethyl amine oxide amphoteric surfactant comprises a mixture of lauryl dimethyl amine oxide and myristyl dimethyl amine oxide and the anionic surfactants are (a) ammonium poly(oxyethylene) lauryl ether sulfate having an average ethoxy content of around 0.6/mole and (b) a mixture of lauryl ether carboxylate and myristyl ether carboxylate having an average ethoxy content of more than 3/mole.

7. The cleaning composition according to claim 1, which further comprises water.

8. The cleaning composition according to claim 1, wherein the surfactant combination is present in an amount of 10 to 17% by weight of the composition.

9. A method of cleaning a surface, comprising contacting the surface with a cleaning composition according to claim 1.

10. The cleaning composition according to claim 3, wherein the average ethoxy content of the poly(oxyethylene) alkyl ether sulfate is about 0.6/mole.

11. The cleaning composition of claim 1, wherein the surfactant combination consists of:

(i) the alkyl dimethylamine oxide amphoteric surfactant;

(ii) the first anionic surfactant consisting of the poly (oxyethylene) alkyl ether sulfate; and (iii) the second anionic surfactant consisting of the alkyl ethoxy carboxylate.

* * * * *